United States Patent [19]

Phol

[11] 4,440,466

[45] Apr. 3, 1984

[54] WIRE CONNECTOR

[75] Inventor: Karl-Heinz Phol, Woodbury, Conn.

[73] Assignee: The Siemon Company, Watertown, Conn.

[21] Appl. No.: 271,603

[22] Filed: Jun. 8, 1981

[51] Int. Cl.[3] ..... H01R 11/22

[52] U.S. Cl. ..... 339/97 P

[58] Field of Search ..... 339/97 P, 97 R, 276 A, 339/276 R, 95 R, 98, 99 R

[56] References Cited

U.S. PATENT DOCUMENTS 3,132,913 5/1964 Pohl ..... 339/97 P 3,790,918 2/1974 Dauser ..... 339/97 R

*Primary Examiner*—Eugene F. Desmond
*Assistant Examiner*—David L. Pirlot
*Attorney, Agent, or Firm*—David S. Fishman

[57] ABSTRACT

A wire formed multiple terminal solderless connector element. The connector element is comprised of plural loops which are in part defined by straight parallel side sections. The straight side sections of adjacent loops are in abutting contact and adjacent loops are interconnected by base portions which include nonparallel extensions of the straight side sections.

5 Claims, 2 Drawing Figures

WIRE CONNECTOR

BACKGROUND OF THE INVENTION (1) Field of the Invention

The present invention relates to the field of solderless, electrical connectors. Specifically, the present invention is directed to a solderless, multiple terminal connector comprising a single length of wire formed into a series of abutting loops.

(2) Description of the Prior Art

In many applications, particularly in the telephone art, it is necessary to make multiple interconnections between small diameter insulated conductors in confined places where the use of screw type terminal strips or similar connecting devices is undesirable and/or impractical. In addition, it is often difficult to remove insulation from such small conductors without materially damaging the conductor. Similarly, it is difficult to hold such small conductors in place while the connector components are manipulated to perfect fastening. The desirable features of known solderless connectors, which are directed to overcoming these problems, are offset by the number and the sizes of the components usually found in such connectors. A further deficiency of known solderless connectors resides in the alternative difficulty of tinning the contact surfaces, in the interest of insuring good electrical contact, without materially inhibiting the ability of the connector to penetrate the insulation covering the conductor.

Heretofore known methods of forming solderless connector structures from round wire stock overcome the above-mentioned dificulties but are generally unacceptable in applications such as those regularly encountered in the telephone art where high connector to conductor interfacial contact pressures are essential in order to perfect a noiseless connection. One type of solderless multiple terminal electrical connector, which was an improvement over the prior art clip type connectors, is disclosed in my prior U.S. Pat. No. 3,132,913.

SUMMARY OF THE INVENTION

The present invention overcomes the above briefly discussed deficiencies and disadvantages of the prior art by providing a novel and improved terminal defining element for use in a solderless connector. A terminal element in accordance with the present invention is formed from a length of round conductive wire stock and has a plurality of adjacent interconnected loops. These loops are, in part, defined by straight side sections which are parallel. Straight side sections of adjacent loops are in abutting relationship. The adjacent loops are interconnected by base portions which include arcuate, preferably semi-circular, sections which join nonparallel extensions of straight side sections of adjacent loops. The terminal defining elements are formed such that the level at which the loop side sections depart from parallelism to define the loop-to-loop interconnections is at or below the stop which determines the limit of conductor insertion in a connector in which the terminal element is to be used.

BRIEF DESCRIPTION OF THE DRAWING

The present invention may be better understood and its numerous objects and advantages will become apparent to those skilled in the art by reference to the following drawing, wherein like reference numerals refer to like elements in the several FIGS., and wherein.

DESCRIPTION OF THE PREFERRED EMBODIMENT

Figure 1:
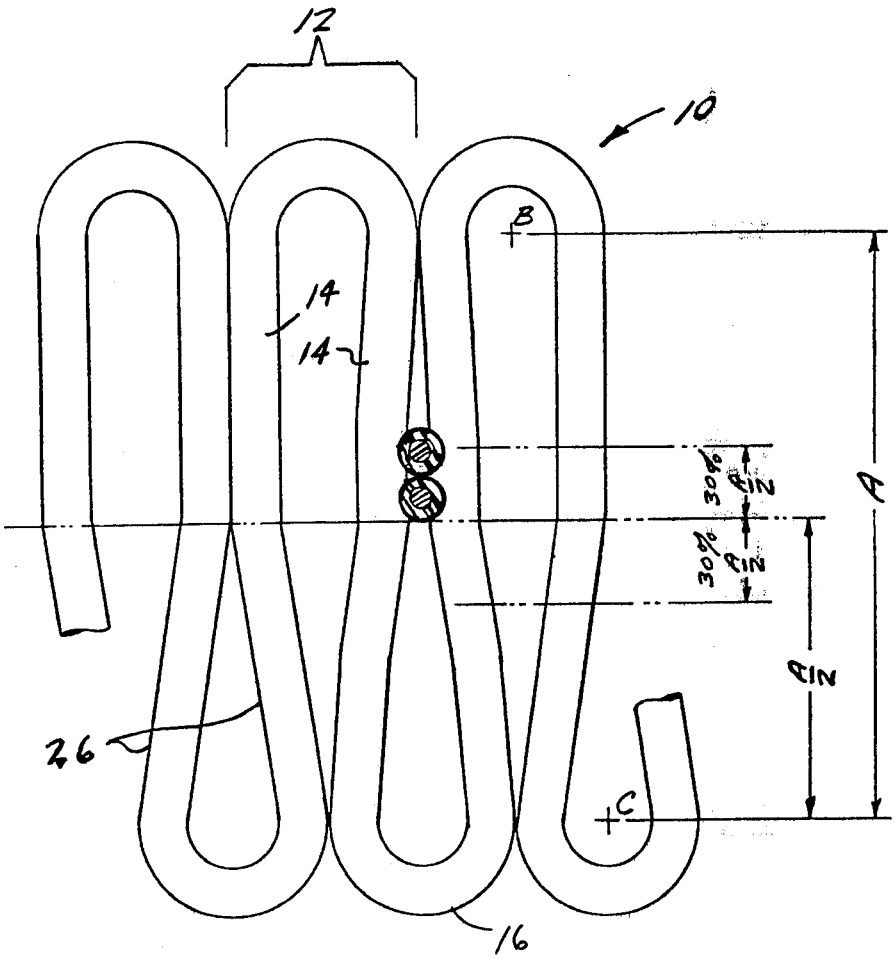
FIG. 1 is a side elevation view of a solderless multiple connector in accordance with the present invention.

Referring to FIG. 1 a portion of a solderless multiple connector in accordance with the present invention is indicated generally at 10. Connector 10 is comprised of a discrete number of connector loops 12. Connector loops 12 are generally tear shaped and have two straight side sections 14 which are parallel. The discrete loops 12 of connector 10 are interconnected by base loops 16. The straight parallel side section 12 has a straight nonparallel extension 26 with interconnecting arcuate sections forming the base loops 16, with the length of each nonparallel extension being greater than the radius of the interconnected arcuate sections. The connector 10 is formed from a continuous filament of round, electrically conductive wire stock. The complete conductor 10 is shaped so that the straight side sections 14 of adjacent connector loops 12 are in contact throughout their entire length. As seen in FIG. 1, the length of the parallel side sections 14 is preferably half the distance, A, between parallel lines which extend through the centers of the connector loops 14 and the interconnecting base loops 16.

Figure 2:
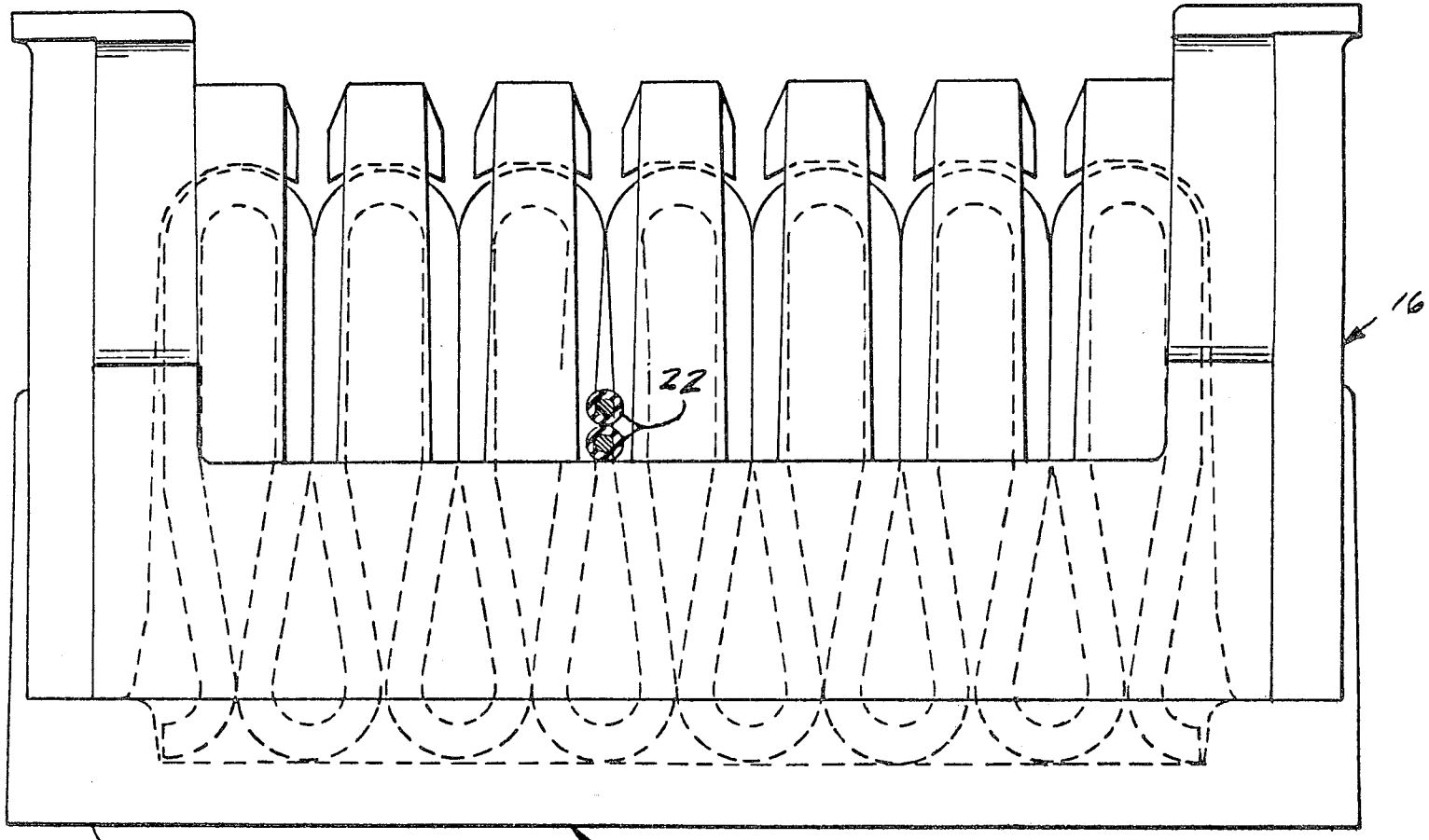
FIG. 2 is a side view of a mounting block useful for housing the connector of claim 1, with portions of the block and connector shown in phantom.

Referring jointly to FIGS. 1 and 2, the connector 10 of the present invention will typically be placed within a connector block 18. Block 18 is configured so as to retain the shape of the individual connector loops 12. An example of a connector block 18 suitable for use with the present invention is disclosed in my co-pending U.S. Application Ser. No. 184,665, filed Sept. 8, 1980, which was subsequently incorporated in continuation-in-part application Ser. No. 269,551, filed June 9, 1981, and now is U.S. Pat. No. 4,381,880, which is incorporated by reference herein. As fully disclosed in co-pending application, Ser. No. 184,665, block 18 is provided with slots for receiving discrete lengths of connector 10 and has a snap-on retainer 20 which secures plural of the connectors 10 within the block 18. Block 18 is further provided with an internal floor or surface 22. Portions of the connectors 10 extend above floor 22. This arrangement allows wires such as the insulated conductors 24 to be inserted between the two adjacent side sections 14 of a pair of loops 12.

In order to assure electrical contact between the side sections 14 and the wire conductors 24, it is preferable that floor 22 of block 18 be located at or slightly above the level where the side sections of the loops 12 of the connectors deviate from parallelism to define the base loops 16. This assures that when a conductor is inserted into a connector 10 it will lie between two initially straight and parallel abutting side sections 14. If it is desired to position two electrical conductors between one pair of abutting side sections 14 then it is permissible to vary the position of floor 22, i.e., the distance A/2,±30% from the mid-point between the centers of the opposite loops 12 and 16. This will be accomplished by varying the slope of the nonparallel side walls 26 of the loops.

In addition to the requirement that the parallel abutting straight side sections 14 of each adjacent pair of loops extend to or below the point to which a conductor may be inserted, adjacent base loops 16 should also preferably have points of contact. These points of contact, and the prevention of overlapping or other significant lateral movement of loops 12 which results from the configuration of block 18, causes the straight sections 14 to function as end supported beams which can bend to accept an inserted conductor or conductors. The foregoing, in turn, results in the application of an insulation shearing force to an inserted conductor which is initially high and which decreases in the direction of insertion. Accordingly, the connector will remove the insulation but will not produce cold working of the conductor of an inserted wire.

While the preferred embodiments have been shown and described, various modifications and substitutions may be made thereto without departing from the spirit and scope of the invention. Accordingly, it is to be understood that the present invention has been described by way of illustration and not limitation.

What is claimed is:

1. A multiple terminal solderless electrical connector comprising:

a discrete number of interconnected loops, said loops being formed from a continuous piece of conductive resilient material, said loops from being arranged in a co-planar relationship between two end loops, said loops each having two straight parallel side portions connected by a semi-circular portion, said straight side portions of adjacent of said loops being in an abutting relationship, at least all of those loops intermediate the end loops having non-parallel extensions of said straight side portions, said extensions each having an arcuate section which connects with an arcuate section of an extension of an adjacent loop whereby said extensions interconnect the abutting side portions of adjacent loops through open loops between each pair of said extensions, the length of each of said extensions being greater than the radius of said connected arcuate sections, the length of said straight parallel side portions being at least approximately half the distance (A) between a pair of parallel lines extending respectively through the centers of said loop semi-circular portions and said connected arcuate sections of said side portion extensions in a direction perpendicular to said straight side portions.

2. The connector of claim 1 wherein said conductive resilient material is conductive wire having a circular cross-section.

3. The connector of claim 1 wherein said extensions of said side portions of each intermediate loop are non-parallel and converge to points of contact, said arcuate sections extending from said points of contact.

4. The connector of claim 3 wherein said arcuate sections are semi-circular.

5. The connector of claim 2 wherein the lengths of said straight parallel side portions are in a range of from A/2+30% of A/2 to A/2–30% of A/2.

* * * * *

UNITED STATES PATENT AND TRADEMARK OFFICE

CERTIFICATE OF CORRECTION

PATENT NO. : 4,440,466

DATED : April 3, 1984

INVENTOR(S) : Karl-Heinz.Pohl

It is certified that error appears in the above-identified patent and that said Letters Patent are hereby corrected as shown below:

On the title page;

The inventor's last name should have been spelled Pohl.

Signed and Sealed this

*Sixteenth* Day of *July 1985*

[SEAL]

*Attest:*

DONALD J. QUIGG

*Attesting Officer* *Acting Commissioner of Patents and Trademarks*